US006327734B1

(12) United States Patent
Meginniss, III et al.

(10) Patent No.: US 6,327,734 B1
(45) Date of Patent: Dec. 11, 2001

(54) FORCE SENSING SYSTEM FOR A TOOTHBRUSH

(75) Inventors: Stephen M. Meginniss, III; Matthew D. Bixby, both of Seattle, WA (US)

(73) Assignee: Philips Oral Healthcare, Inc., Snogualmie, WA (US)

( * ) Notice: Subject to any disclaimer, the term of this patent is extended or adjusted under 35 U.S.C. 154(b) by 0 days.

(21) Appl. No.: 09/561,274

(22) Filed: Apr. 28, 2000

(51) Int. Cl.[7] ..... A46B 9/04
(52) U.S. Cl. ..... 15/105; 15/167.1; 15/205.2
(58) Field of Search ..... 15/105, 167.1, 15/172, 205.2

(56) References Cited

U.S. PATENT DOCUMENTS 4,694,844 * 9/1987 Berl et al. .
4,744,124 * 5/1988 Wang et al. .
5,146,645 * 9/1992 Dirksing .
5,331,707 * 7/1994 Irizarry .
5,355,544 * 10/1994 Dirksing .
5,799,354 * 9/1998 Amir .
5,836,036 * 11/1998 Ivory .
5,876,207 * 3/1999 Sundius et al. .
5,987,690 * 11/1999 Heuler .

FOREIGN PATENT DOCUMENTS 9-182623 * 7/1997 (JP) .
WO 01/21035 * 3/2001 (WO) .

* cited by examiner

*Primary Examiner*—Terrence R. Till
(74) *Attorney, Agent, or Firm*—Ernestine C. Bartlett

(57) ABSTRACT

The pressure sensing system includes a hinged member that is fixedly attached to a brushhead body. An arm member is attached at one end to said hinged member and pivots about a hinge portion of the hinged invention. The pivoting arm member and the brushhead member nestle within the toothbrush body. The brushhead member includes a striking element portion that extends away from a rear surface of the brushhead. Mounted on the toothbrush body beneath the brushhead member is a collapsible, recoverable dome member, which provides an alarm indication by collapsing when excessive pressure is applied by the user on the brushhead against the teeth.

30 Claims, 3 Drawing Sheets

FIG. 5
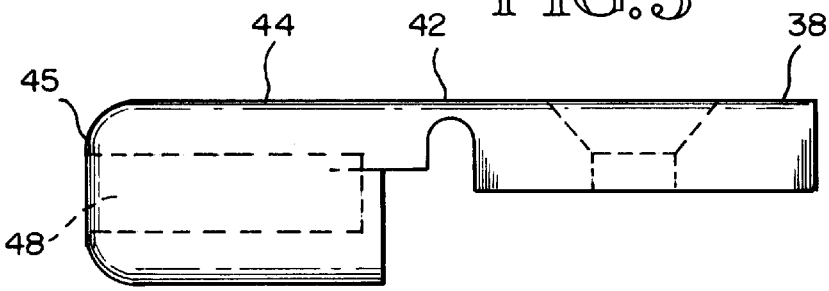
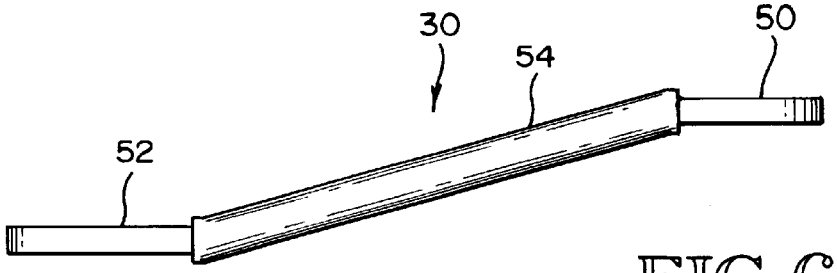
FIG. 6
FIG. 7
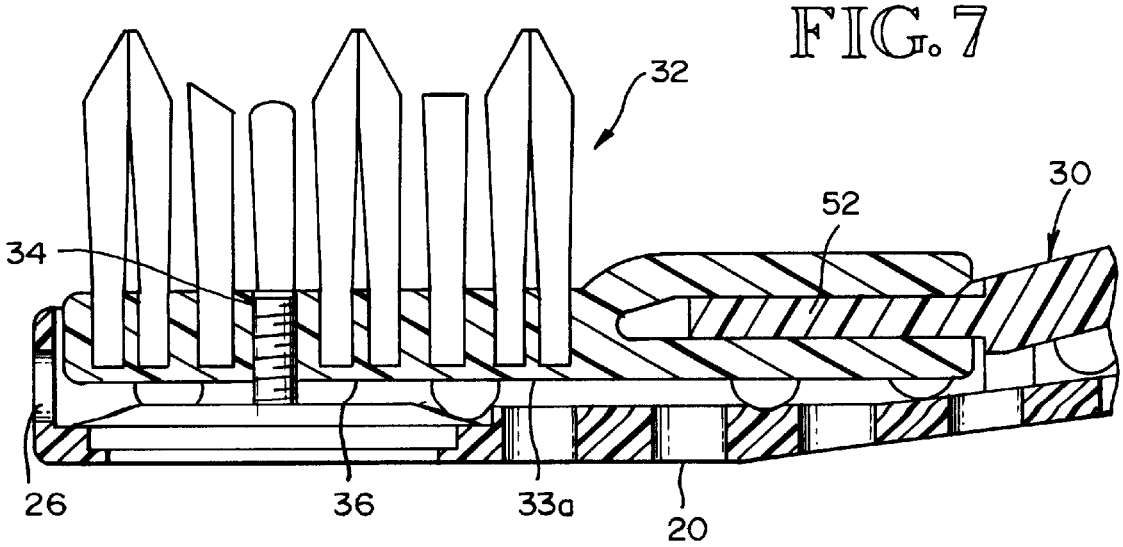

FORCE SENSING SYSTEM FOR A TOOTHBRUSH

TECHNICAL FIELD

This invention relates generally to force, i.e. pressure, sensors for toothbrushes, and more particularly concerns a mechanical force sensor for use on a toothbrush.

BACKGROUND OF THE INVENTION

It is well known that excessive brush force applied against the teeth during brushing over an extended period of time is detrimental to oral health, causing wear of gum tissue and eventually the teeth enamel. This is true whether the brushing is accomplished manually or with a power toothbrush, although a power toothbrush may accentuate the effect. To avoid this, it is quite typical for a dental patient to receive instructions from the dental professional to use less pressure during brushing.

However, it is often quite difficult for an individual to self-monitor the pressure applied on the brush against the teeth and to maintain it within an acceptable range over the course of the brushing event. An acceptable range of pressure that is not injurious to the gums or teeth is known and has been verified experimentally. However, the typical toothbrush does not have a capability of measuring applied pressure and the tendency of individual users is to exert too much pressure against the teeth, particularly since a firm "scrubbing" action is usually regarded by the populace as being most effective for cleaning. As explained above, however, excessive or heavy scrubbing can lead to gum and even teeth damage.

In order to address and attempt to solve this issue of excessive pressure, pressure sensors of various types have been developed, although most are primarily for use with power toothbrushes, where the possibility of tissue and teeth damage is generally greater than for manual toothbrushes. Pressure sensors have been developed specifically for manual toothbrushes as well, however.

Known pressure sensors include various mechanical arrangements, including for example those shown in U.S. Pat. Nos. 5,146,645 and 5,355,544, both to Dirksing, which include a handle portion which deforms when excessive pressure is applied. Various kinds of electrical pressure sensing devices and/or direct pressure sensors have been used. Some examples of electrical-type pressure sensors include U.S. Pat. No. 4,450,599 to Scheller et al, U.S. Pat. No. 4,716,614 to Jones et al and U.S. Pat. No. 5,282,291 to Spieler et al. Still other examples include U.S. Pat. No. 5,784,742 and U.S. Pat. No. 5,815,872, both assigned to the assignee of the present invention.

In many of these devices, when a selective pressure threshold is reached, an electrical signal is produced, which is applied to an alarm mechanism. All of the above devices use an alarm of some kind, whether tactical, auditory or visual, to alert the user that the selected excessive pressure threshold has been exceeded. The user will then reduce the pressure being applied against the teeth until it goes below the pressure threshold, at which point the alarm ceases.

However, such previous pressure sensors typically are either quite expensive and/or complex, or in some cases are not reliable over an extended period of time. For a manual toothbrush, those pressure sensors which are in fact reliable in operation are often simply too expensive. A force or pressure sensor which is suitable for a manual toothbrush, such as that of the present invention, must be simple in structure and operation, must be reliable, and also must be economical. The total cost of the resulting manual toothbrush, including the pressure sensor system, must be reasonably competitive with other manual toothbrushes.

SUMMARY OF THE INVENTION

Accordingly, the invention includes a pressure sensing system for a toothbrush which includes a toothbrush body, comprising: an elongated hinged member attached at one end to the toothbrush body, the hinged member having a hinge portion and an arm portion, wherein the arm portion rotates about the hinge portion and is arranged and configured such that it nestles substantially within the toothbrush body; a brushhead member attached to a distal end of the arm portion, the brushhead member having a base portion; a striking element which extends away from either a rear surface of the base portion of the brushhead member or up from the brushhead receiving portion; and a collapsible, recoverable dome element, mounted on the other end of the toothbrush body beneath the brushhead member or the rear surface of the base portion of the brushhead member, wherein in operation the dome member collapses, producing an indication of excess pressure, when a threshold amount of pressure is exerted on the dome element by said striking element, indicating that a user of the toothbrush is applying excessive force on the brushhead against the teeth.

Another aspect of the invention includes a manual toothbrush body, comprising: a handle portion, suitable in size and configuration for a user to grasp; and a forward portion extending from the handle portion to a distal end of the toothbrush body, the forward portion being adapted to receive a brushhead member in the vicinity of the distal end of the toothbrush body and a pressure member mounted beneath the brushhead member, wherein the forward portion has openings therein along the length thereof to permit flow of rinsing fluid therethrough and to facilitate drying of the toothbrush body between uses.

BRIEF DESCRIPTION OF THE DRAWINGS

FIG. 5 is a side elevational view of a portion of the pressure sensing system of FIG. 1.

FIG. 6 is a side elevational view of another potion of the pressure sensing system of FIG. 1.

FIG. 7 is a cross-sectional view of a portion of the pressure sensing system of FIG. 1.

BEST MODE FOR CARRYING OUT THE INVENTION

Figure 1:
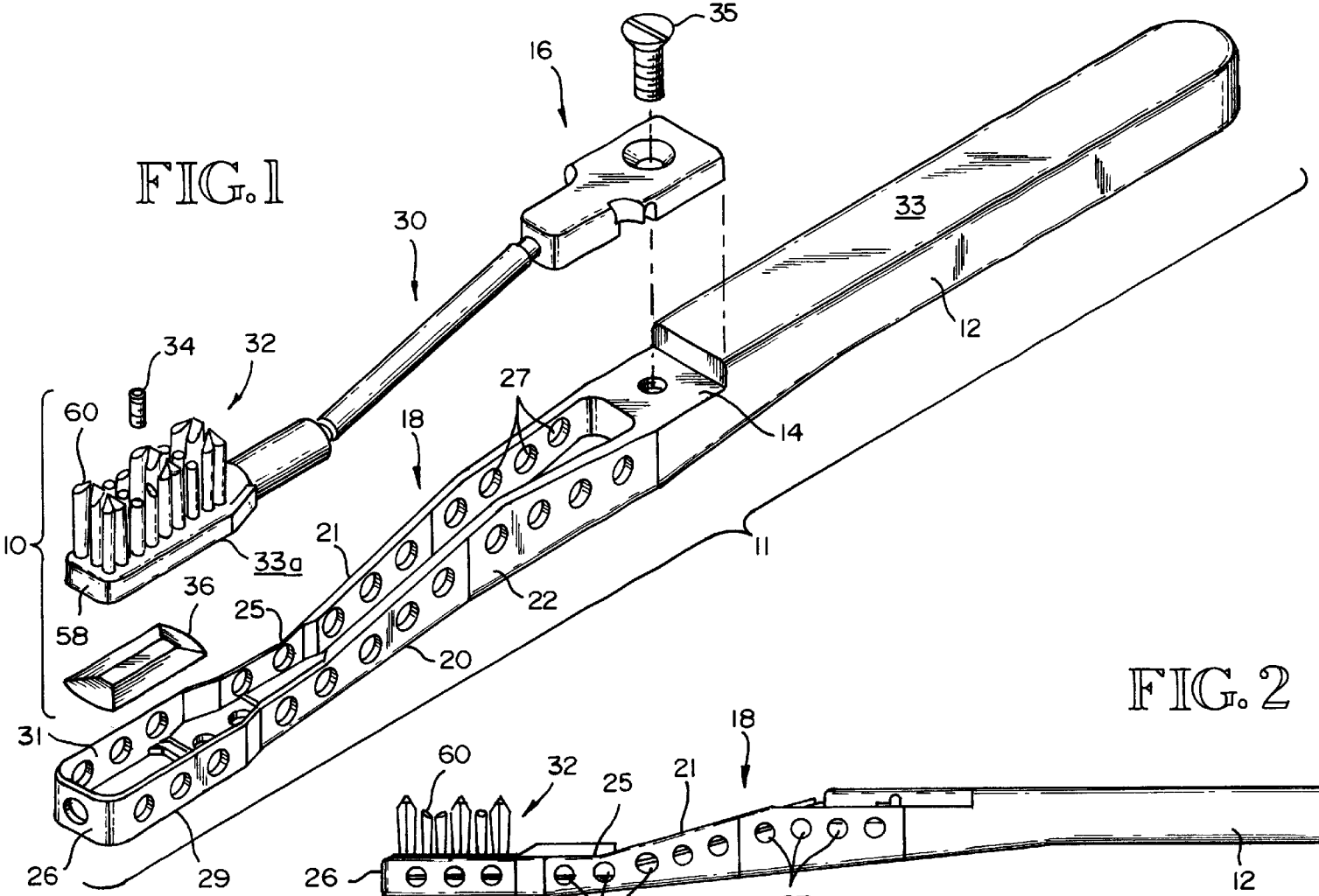
FIG. 1 is a partially exploded view of the pressure sensing system of the present invention, shown with a manual toothbrush body.

FIG. 1 shows the pressure sensing system 10 of the present invention 10 and a toothbrush body referred to generally at 11. Generally, toothbrush body 11 will be a manual toothbrush. The toothbrush body 11 includes a handle portion 12, which is configured to be grasped by the hand of the user. In the embodiment shown, handle 12 is approximately 3.75 inches long, while the entire toothbrush body 11 is approximately 7.5 inches long. In the embodiment shown, toothbrush body 11 is made of a filled nylon, but could be other materials as well, including polypropylene and other plastics. Handle portion 12 is in the embodiment shown approximately 0.5 inches wide and approximately ⅜-inch high. The handle portion 12 is closed about all four sides and its two ends.

Figure 2:
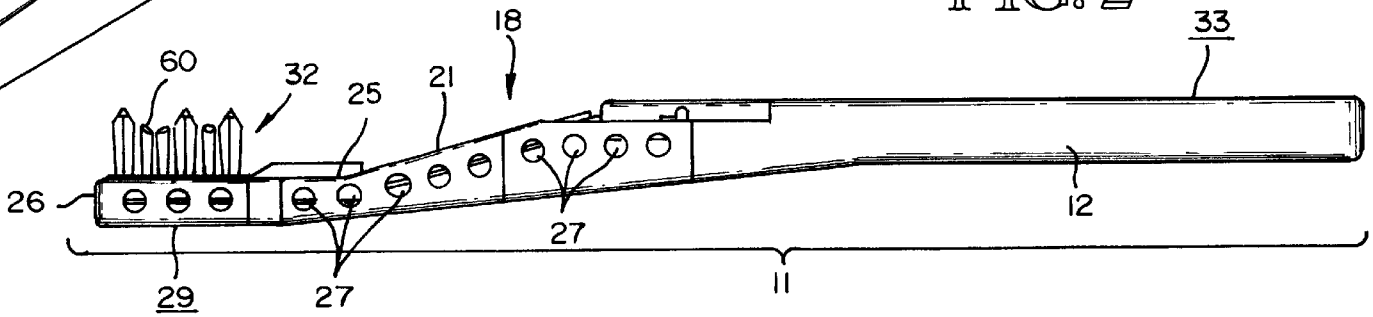
FIG. 2 is a side view of a portion of the pressure sensing system of FIG. 1.

At the distal end of handle 12 is a portion 14 which in the embodiment shown is adapted to receive a hinged member portion 16 of the pressure sensing assembly 10. The remaining portion of the toothbrush body is referred to at 18, and is generally U-shaped in cross-section, open at the top. The remaining portion 18 comprises a base 20, two upstanding sides 21, 23 and a forward end wall 26. This arrangement provides rigidity for the toothbrush body. From the receiving portion 14, toothbrush body 11 begins to taper inwardly at both sides over a short distance until the width of the toothbrush body is approximately 0.25 inches. Over this distance, the top edges of the sides 21, 23 toothbrush body are flat for a small distance and then angle downwardly until point 25 on the toothbrush body. Over this distance, base 20 angles slightly downwardly. The drawings show this structural arrangement, in particular FIG. 2.

From point 25 to forward end wall 26, the toothbrush body is flat and is adapted to receive a conventional toothbrush brushhead 32. The distance from the lower surface 29 of the flat section 31 to the upper surface 33 of handle portion 12 is approximately 0.75 inches, while the height of the toothbrush body in the flat section 31 is approximately 0.28 inches.

The sides 21 and 23 and the base 20 over the length of the toothbrush body from receiving portion 14 to the forward end wall 26 have a plurality of openings 27—27 therethrough. In the embodiment shown, these openings are circular, approximately 0.125 inches in diameter, spaced approximately 0.25–0.35 inches apart. In base 20 of flat section 31 is an elongated slot 37, which is discussed in more detail below. The openings could have other shapes and spacing, however. The use of openings, with an entirely open top, has several advantages. It allows fluid to easily escape the brush, without trapping oral tissue in the openings. This arrangement further permits the use of the hinged arm pressure sensing assembly 11 without the use of seals between the arm and the body. The openings further are large enough to not only allow rinsing water to move freely in and through the toothbrush body during cleaning, but also allows the unit to dry out thoroughly between uses.

Figure 4:
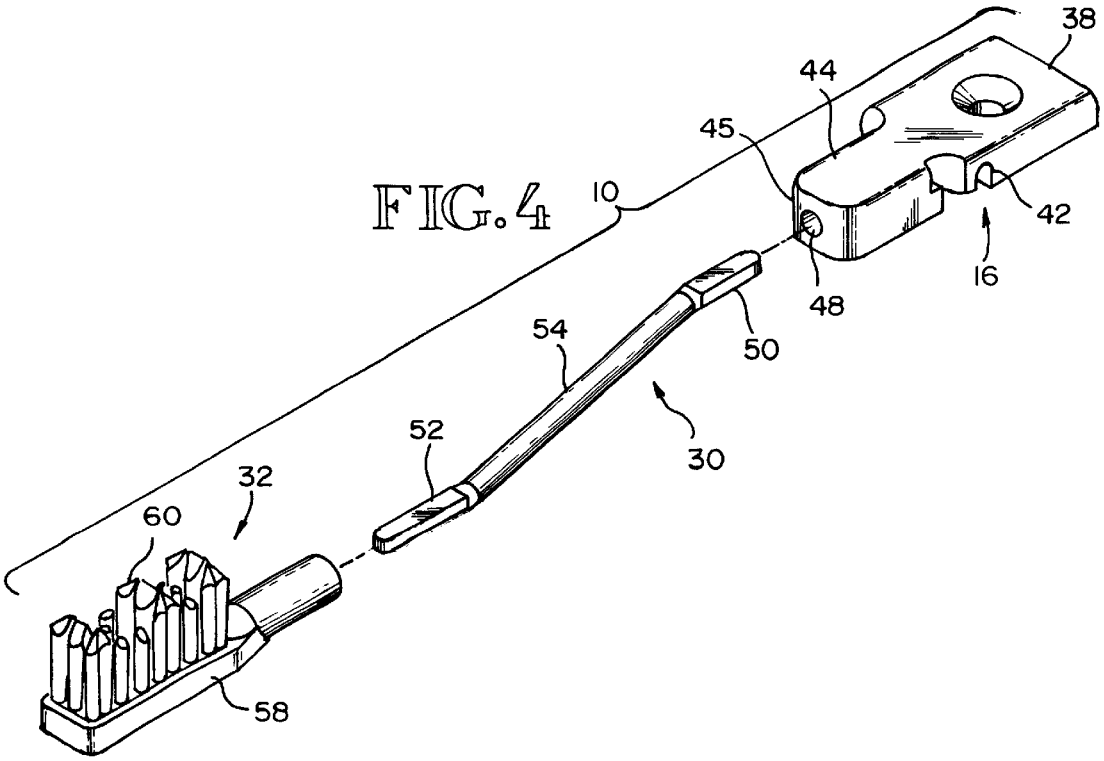
FIG. 4 is an exploded view of the pressure sensing system of FIG. 1.

The pressure sensor assembly 10 is shown in relation to the toothbrush body 11 in FIG. 1, and in an exploded view by itself in FIG. 4. Two of the component parts thereof are furthermore shown in more detail in FIGS. 5 and 6. The pressure sensor assembly/system includes a hinged member 16, an elongated arm 30, a brushhead 32 which includes a striking element 34 extending away from a rear surface 33 of the brushhead, and a deformable dome element 36, conventionally referred to as a "snappy" member, since it makes a snap-like sound when deformed past a threshold point. Most round snap domes cannot be moved beyond a "flat" position without turning inside out. The rectangular snap dome shown and described herein can be moved to a "beyond flat" position, thereby providing a longer collapsing distance and greater tactile feel.

Hinged member 16 is attached to toothbrush body 11 at receiving portion 14, by means of a screw 35 or the like. It could also be a quick disconnect arrangement to allow convenient replacement of the brushhead. Hinged member 16 in the embodiment shown is made from polypropylene or acetal resin (Delrin) or similar plastic. The hinged member 16 (FIG. 5) includes a rear portion 38 which is approximately square in the embodiment shown and approximately ⅛-inch thick. Forward of base portion 38 is a narrow hinge portion 42 which in the embodiment shown is approximately 0.015 inches thick, which is sufficiently thin to permit a hinge-like action, and approximately one-half inch wide.

Forward of hinge portion 42 is a receiving portion 44, which is approximately 0.25 inches thick. The receiving portion 44 is approximately 0.3–0.5 inches wide at hinge portion 42 and tapers to approximately 0.3 inches at a forward end 45 thereof. The longitudinal edges of the receiving portion 44 are in the embodiment shown rounded. The receiving portion 44 is configured to fit within the toothbrush body, near a rear end of the remaining open portion 18 thereof. An octagonal (in cross-section) central opening 48 extends longitudinally inward of receiving portion 44 from forward end 45 and receives one end of an arm 30.

Elongated arm 30 in the embodiment shown (FIG. 4) includes proximal and distal portions 50 and 52, connected by an intermediate rod-like portion 54. In the embodiment shown, arm 30 is made from stainless steel, but other materials could be used as well, such as various plastic materials. Proximal portion 50 is approximately 0.4 inches long and is configured to snugly fit into opening 48 in receiving portion 44 of the hinged member, while distal portion 52 upon which brushhead 32 is mounted is approximately 0.5 inches long. The intermediate portion 54 is approximately 1.328 inches long in the embodiment shown.

The arm 30 has a total length of 2.245 inches, because the intermediate portion is arranged such that it angles downwardly between the proximal and distal portions. The distance between the centerlines of the proximal and distal portions is approximately 0.35 inches. The angle of the intermediate portion of the embodiment shown is approximately within the range of 5°–20°, preferably 15°. The intermediate portion 54 is configured to closely follow the portions of the toothbrush body in which it fits.

Although the hinged member 16 and arm 30 are shown as two pieces in the present embodiment, they could be made, i.e. molded, as a single unit.

Mounted on distal end portion 52 of arm 30 is a brushhead 32. Brushhead 32 includes a base portion 58 and a bristle portion 60 which is mounted in base 58 and extends upwardly therefrom in conventional fashion. The bristle portion can take various configurations, including conventional arrangements or special configurations to accomplish particular brushing effects. In the arrangement shown, the tops of the bristles are in approximately the same plane as the hinge portion 42 of the hinged member to prevent in/out brushing forces at the bristle tips from causing turning moments around the hinge member and distorting the accuracy of the force sensing system. The combination of the hinged member 16, arm 30 and brushhead 32 can be replaceable as a unit if desired.

Mounted in the base of the brushhead, approximately central thereof in the embodiment shown, is a set-screw which is the striking element 34. The set-screw extends through the base portion 58 and below the lower surface 33 of the brushhead, approximately 0.08 inches in the embodiment shown. The setscrew in the embodiment shown is approximately 3/32 inches in diameter and ⅛ inch long and is made from stainless steel. Alternatively a bump could be molded into the toothbrush base portion 58. Further, the hinged element, the arm and the brushhead could be a single piece. The brushhead 32 could also be made removable from the arm portion.

When hinged member 16 is secured to the receiving portion 14 of the toothbrush body, application of force against the brushhead 32 toward the toothbrush body will result in the brushhead moving about hinged portion 42 of hinged member 16.

A thin dome element 36 is secured to interior surface of flat section 31 of the toothbrush body, directly beneath base portion 58 of the brushhead. Dome element 36 in the embodiment shown is a conventional snap dome member having an obround configuration, similar generally to a child's "cricket" toy. In the embodiment shown, the dome element is approximately 0.7 inches long, 0.35 inches wide and 0.015 inches high. The obround snap dome element 36 is capable of moving "beyond flat" when it suddenly collapses due to pressure against it exceeding a particular value by action of the striking element 34. This is shown by the dotted lines in FIG. 7. The "beyond flat" capability, as discussed above, is important to provide a sufficient collapsing distance that the user can recognize the collapse of the element. The snap dome is mounted on a ridge within the brushhead receiving portion to permit the center portion of the snap dome element to go beyond flat.

In the embodiment shown, the dome element collapses approximately 1/16 inch, and beyond flat by approximately 0.045 inches. The force necessary to collapse the dome in the embodiment shown is 200–400 grams, depending on the particular dome element. Snap dome elements are available with various collapse forces within the above range. Selected force values within this range are generally reasonable as a threshold for excessive pressure.

Figure 3:
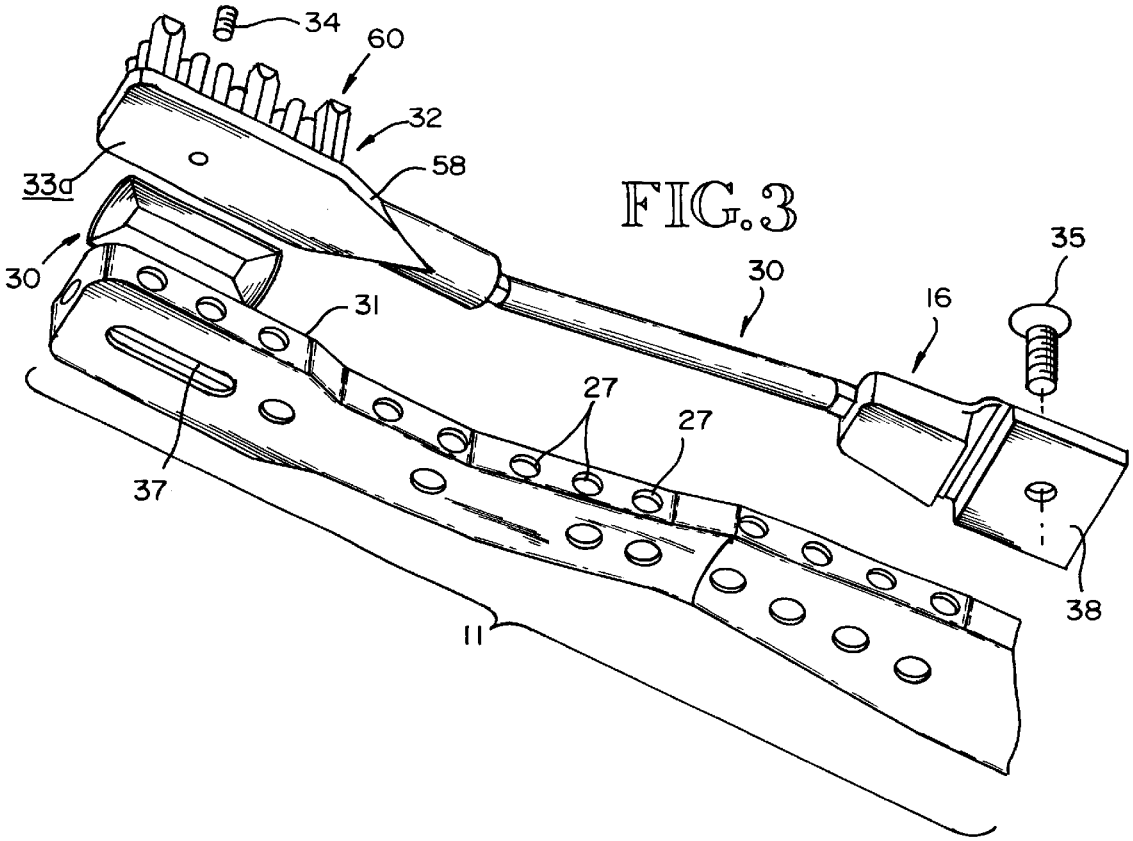
FIG. 3 is a perspective view of the pressure sensing system of FIG. 1 from beneath the toothbrush body.

The snap dome is secured to the toothbrush body beneath the brushhead by means of an adhesive or tape or a trapping element. Slot 37 (FIG. 3) in the base portion of the toothbrush body extends beneath the snap dome, and prevents the possible damping of the snap dome action due to fluid being trapped beneath the dome when it collapses. The slot allows the ready escape of the fluid from the toothbrush body and allows for complete rinsing and drying of the toothbrush between uses.

When the threshold pressure of the snap dome element is reached, the dome collapses, providing both an immediate tactile response (the brushhead suddenly moves approximately 1/16 inch) and also a distinctive "cricket-like" sound, making it readily noticeable to the user. The collapse of the dome element 36 is thus an easily recognizable indication of excessive pressure of the brushhead against the teeth.

When the pressure is released, the snap dome element 36 rebounds or recovers to its original configuration, with another distinctive sound and feel (less than 100 grams of differential force). The advantage of the snap dome arrangement is that it can collapse and recover a substantial number of times at approximately the same pressure, far more than the expected actual individual uses of the toothbrush.

In the embodiment shown, the snap dome element is secured to the toothbrush body beneath the brushhead and the striking element extends from the brushhead. In another embodiment, the snap dome element could be positioned on a lower surface of the brushhead and the striking element could be positioned on the toothbrush body beneath the brushhead.

In operation, the user typically will use the toothbrush in conventional fashion and learn to maintain proper pressure. The number of snaps will thus typically decrease over time, such that the average brushing pressure will be reduced generally to a safe level, preventing damage to the gums and teeth. However, some users will find it difficult to reduce brushing pressure to an appropriate level without a reminder. Such users must be reminded during every brushing to brush with less pressure. The present device is capable of providing such consistent reminders.

While the toothbrush body performs the important function of providing a base of support for the snap dome element, it also functions as a rigid shield which holds the tissues inside the mouth away from the moveable brushhead, and prevents the tissue pressures from affecting the snap dome operational force. This is an important consideration in maintaining accurate brushing pressure sensing, particularly for those people having oral tissues that tend to strongly force the brush against the teeth and gums. It thus permits a true measure of force on the bristles. In some cases, the user will have to actually exert pressure away from the teeth and against the mouth tissues in order to be below the threshold force level.

Hence, a pressure sensing system has been disclosed which is convenient for use with a manual toothbrush. The present invention has the advantages of simplicity, reliable operation and also is quite economical. In addition, the system senses a true brushing pressure, i.e. it takes into account any force exerted by the mouth tissues on the brushhead against the teeth. Without a toothbrush body acting as a shield, there would be increased and very significant unmonitored bristle pressure due to the mouth tissues.

A preferred embodiment of the above-identified invention has been described. However, it should be understood that various changes, modifications and substitutions may be made without departing from the spirit of the invention, which is defined by the claims that follow.

What is claimed is:

1. A pressure sensing toothbrush, comprising:

a toothbrush body;

an elongated hinged member having a hinge portion and an arm portion, wherein the hinged member is attached at one end to the toothbrush body and wherein the arm portion moves about the hinge portion and is positioned substantially within and along the toothbrush body;

a brushhead member attached to a distal end portion of the arm portion, said brushhead member having a base portion; a striking element which extends away from one of (a) the base portion of the brushhead member and (b) the toothbrush body beneath said brushhead; and a collapsible, recoverable dome element, mounted on the other of (a) the base portion of the brushhead member and (b) the toothbrush body beneath said brushhead member, wherein in operation the dome member collapses, producing an indication of excess pressure, when a threshold amount of pressure is exerted on said dome element by said striking element, indicating that a user of the toothbrush is applying excessive force on the brushhead against the teeth.

2. An article of claim 1, wherein the dome member collapses approximately 1/16 inch.

3. An article of claim 1, wherein the arm portion is configured such that the tops of the bristles in the brushhead are in approximately the same plane as the hinge portion of the hinged member.

4. An article of claim 1, wherein the hinged member further includes an attaching portion which is fixedly secured to the toothbrush body approximately midlength of the toothbrush body, a receiving portion which is adapted and configured to receive one end of said arm portion, and wherein the hinge portion is a narrow portion intermediate of the attaching and receiving portions and permits flexure of the receiving portion and the arm portion about the hinge portion.

5. An article of claim 4, wherein the hinged member is plastic.

6. An article of claim 1, wherein the arm portion includes a proximal end portion which is attached to the hinged member, the distal end portion to which the brushhead member is attached and an intermediate portion that extends between the proximal end portion and the distal end portion, wherein the intermediate portion angles downwardly from the proximal end portion to the distal end portion, following the angle of that portion of the toothbrush body in which it is positioned.

7. An article of claim 6, wherein the downward angle of the intermediate portion is in the range of 5°–20°.

8. An article of claim 7, wherein the downward angle of the intermediate portion is approximately 15°.

9. An article of claim 1, wherein the toothbrush body includes a handle portion and a forward portion which is generally U-shaped in cross-section so that the arm and brushhead can nestle within the forward portion.

10. An article of claim 9, wherein at least the forward portion of the toothbrush body has openings therein along the length thereof.

11. An article of claim 10, wherein the forward portion of the toothbrush body includes a slot which extends in a base portion thereof, at least under the dome element.

12. An article of claim 1, wherein the dome element is a snappy-type obround dome, which collapses upon a threshold amount of pressure being applied to an upper surface thereof and then recovers to an original configuration upon the pressure being decreased below the threshold amount.

13. An article of claim 12, wherein the dome member collapses a sufficient distance to create a tactile effect which is noticeable to the user and which is accompanied by an audible sound, also noticeable to the user.

14. An article of claim 13, wherein the sufficient distance is at least 1/16 mil and beyond flat.

15. A pressure sensing system for a toothbrush which includes a toothbrush body, comprising:

an elongated hinged member attached in the vicinity of one end to the toothbrush body in the vicinity of a distal end of a handle portion of the toothbrush body, the hinged member having a hinge portion and an arm portion which is configured to nestle within the toothbrush body;

a brushhead member attached to a distal end of the arm portion, said brushhead member including a striking element which extends away from a rear surface of a base portion of the brushhead member; and a collapsible, recoverable dome element mounted in a forward portion of the toothbrush body beneath the brushhead member, wherein in operation the dome element collapses, producing an indication of excess pressure, when a threshold amount of pressure is exerted on said dome element by said striking element, indicating that a user of the toothbrush is applying excessive force on the brushhead against the teeth.

16. An article of claim 15, wherein the dome member collapses approximately 1/16 inch.

17. An article of claim 15, wherein the arm portion is configured such that the tops of the bristles in the brushhead are in approximately the same plane as the hinge portion of the hinged member.

18. An article of claim 15, wherein the hinged member further includes an attaching portion which is fixedly secured to the toothbrush body approximately midlength of the toothbrush body, a receiving portion which is adapted and configured to receive one end of said arm portion, and wherein the hinge portion is a narrow portion intermediate of the attaching and receiving portions and permits flexure of the receiving portion and the arm portion about the hinge portion.

19. An article of claim 15, wherein the arm portion includes a proximal end portion which is attached to the hinged member, the distal end portion to which the brushhead member is attached and an intermediate portion that extends between the proximal end portion and the distal end portion, wherein the intermediate portion angles downwardly from the proximal end portion to the distal end portion, following the angle of that portion of the toothbrush body in which it is positioned.

20. An article of claim 19, wherein the downward angle of the intermediate portion is in the range of 5°–20°.

21. A manual toothbrush body, comprising:

a handle portion, suitable for a user to grasp; and a forward portion extending from the handle portion to a distal end of the toothbrush body, the forward portion being adapted to receive a brushhead member in the vicinity of the distal end of the toothbrush body and a pressure sensing member mounted beneath the brushhead member, wherein the forward portion has openings therein to permit flow of rinsing fluid therethrough and to facilitate drying of the toothbrush body between uses.

22. An article of claim 21, wherein the openings extend for substantially the length of the forward portion.

23. An article of claim 21, wherein the openings include circular openings.

24. An article of claim 21, wherein the openings include a narrow elongated slot in a base part of the forward portion, beneath the pressure sensing member.

25. A pressure sensing toothbrush, comprising:

a toothbrush body having a forward brushhead receiving portion;

an arm assembly coupled to the toothbrush body and having a brushhead nestled in the brushhead receiving portion of the toothbrush body, wherein the arm assembly, including the brushhead, moves in response to pressure against bristles on the brushhead;

a collapsible, recoverable element positioned between the brushhead receiving portion of the toothbrush body and the brushhead, wherein the collapsible, recoverable element collapses when a predetermined value of pressure is applied against the bristles, providing a tactile indication that a predetermined amount of pressure has been exceeded, and wherein the collapsible, recoverable element recovers when the pressure against the bristles falls below the predetermined amount of pressure.

26. An article of claim 25, wherein the collapsible, recoverable element is a snap dome and wherein the snap dome is mounted in a manner to allow the snap dome to go beyond flat when the predetermined amount of pressure is exceeded.

27. A replaceable brushhead and arm assembly for use in a manual pressure-sensing toothbrush which includes a handle portion, suitable for a user to grasp, and a forward portion extending from the handle and adapted to receive the brushhead and at least a part of the arm assembly, comprising:

an arm assembly removably secured to the toothbrush, the arm assembly including a hinge portion;

a brushhead positioned on the distal and of the arm assembly, wherein pressure on the brushhead moves the arm assembly about the hinge portion, the brushhead including a strike member which impacts a collapsible dome member in the toothbrush beneath the brushhead, resulting in a collapse of the dome member, indicative of excess pressure, when a threshold amount of pressure is exerted on said brushhead.

28. An article of claim, 27, wherein the arm assembly includes a hinged member which includes an attaching portion for removably securing the arm assembly to the toothbrush, the hinged member including a receiving portion, wherein the arm assembly further includes an arm portion which extends from the receiving portion of the hinged member.

29. An article of claim 28, wherein the arm portion includes a proximal end portion which is attached to the hinged member, a distal end portion to which the brushhead is attached and an intermediate portion that extends between the proximal end portion and the distal end portion, wherein the intermediate portion angles downwardly from the proximal end portion to the distal end portion, following the angle of that portion of the toothbrush in which it is positioned.

30. An article of claim 29, wherein the downward angle of the intermediate portion is in the range of 5°–20°.

* * * * *